United States Patent [19]

Chechovsky et al.

[11] Patent Number: 4,563,027

[45] Date of Patent: Jan. 7, 1986

[54] DOOR SECURITY BRACE

[76] Inventors: Dardis W. Chechovsky, P.O. Box 751, Cherokee Village, Ark. 72525; Joe H. Jenkins, Horseshoe Bend, Ark. 72512

[21] Appl. No.: 632,425

[22] Filed: Jul. 19, 1984

[51] Int. Cl.[4] ..... E05C 17/54

[52] U.S. Cl. ..... 292/339

[58] Field of Search ..... 292/262, 338, 339, DIG. 15

[56] References Cited

U.S. PATENT DOCUMENTS 598,405 2/1898 Williams ..... 292/339
1,985,164 12/1934 Green ..... 292/338
3,480,247 11/1969 Waner ..... 292/338 X

FOREIGN PATENT DOCUMENTS

WO79/00423 7/1979 PCT Int'l Appl. ..... 292/339

*Primary Examiner*—Richard E. Moore
*Attorney, Agent, or Firm*—B. P. Fishburne, Jr.

[57] ABSTRACT

A longitudinally adjustable and lockable brace bar carries a pivoted foot piece at its lower end having a friction facing to prevent slippage while in contact with the floor. At its other end, the brace bar carries a pivoted yoke on a pivot axis which is parallel to the foot piece pivot axis. The bifurcated yoke engages beneath a door knob shank solidly with the yoke lying in a plane perpendicular to the door knob shank and perpendicular to the plane occupied by the foot piece while the brace bar is at an angle to the door enabling the device to resist entry through the door in an efficient and positive manner.

3 Claims, 5 Drawing Figures

FIG.1
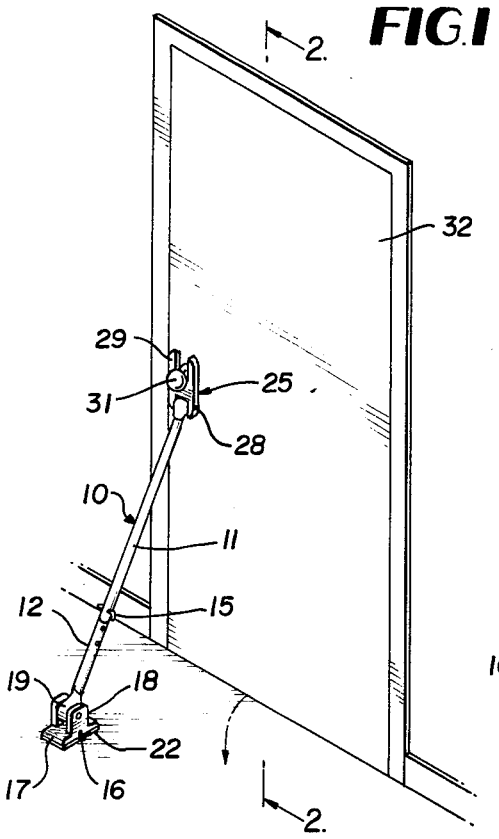
FIG.2
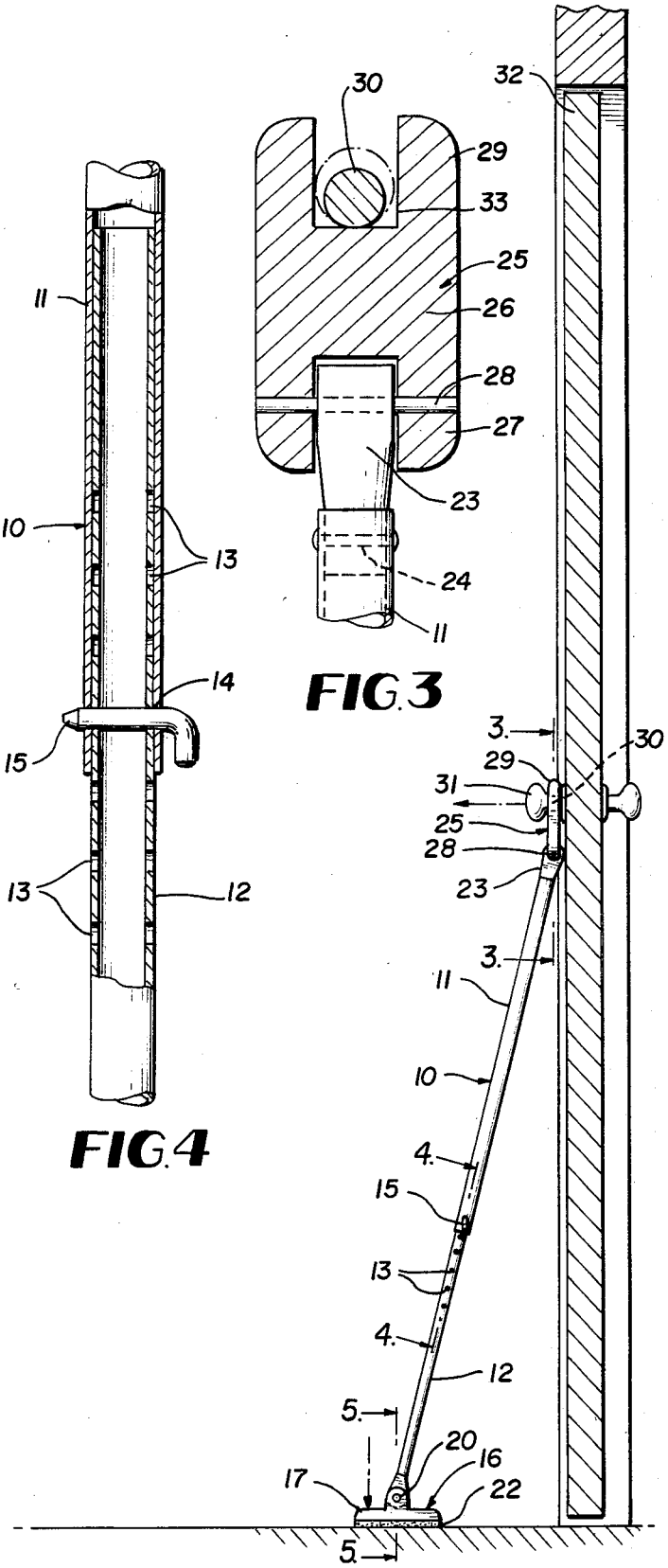
FIG.3
FIG.4
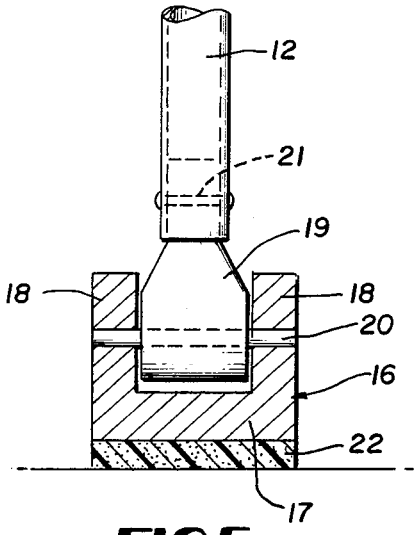
FIG.5

DOOR SECURITY BRACE

BACKGROUND OF THE INVENTION

Prior art security bars or braces for blocking entry through doorways are known. Such devices have not been widely adopted commercially for one of two reasons. The prior art devices which work effectively have been too complex and costly to be practical on the commercial market. Those devices in the prior art which are relatively simple and feasible from a cost standpoint have proven not to operate efficiently with consistency, and therefore have not been acceptable in the marketplace.

Therefore, it is the objective of this invention to provide a door security brace which is entirely practical from an economic cost standpoint and from the standpoint of operational efficiency with consistency.

More particularly, it is the object of the present invention to provide an adjustable door security brace of extreme simplicity and convenience of use, which will effectively resist entry through practically any household or business office interior doorway in which the door to be barred possesses a knob having a shank.

A more specific object of the invention is to provide a door security brace including a length adjustable and lockable bar having a pivoted anti-slip foot piece at its lower end and a parallel axis pivoted bifurcated yoke at its upper end to straddle the door knob shank from its lower side in perpendicular relation thereto while being parallel with the plane of the door and perpendicular to the plane occupied by the foot piece.

Other objects and advantages of the invention will become apparent to those skilled in the art during the course of the following detailed description.

BRIEF DESCRIPTION OF THE DRAWINGS

FIG. 1 is a perspective view of a door security brace according to the present invention.

FIG. 2 is a vertical section taken on line 2—2 of FIG. 1.

FIG. 3 is an enlarged fragmentary vertical section taken on line 3—3 of FIG. 2.

FIG. 4 is a similar section taken on line 4—4 of FIG. 2.

FIG. 5 is a similar section taken on line 5—5 of FIG. 2.

DETAILED DESCRIPTION

Referring to the drawings in detail wherein like numerals designate like parts, a door security brace according to the invention comprises a length adjustable and lockable brace bar 10 including upper and lower telescopically engaged tube sections 11 and 12. The lower tube section 12 is provided with a series of longitudinally spaced adjusting apertures 13 and the upper tube section 11 near its lower end has a single transverse aperture 14 adapted to receive a locking pin 15 which also extends through any selected adjusting aperture 13 of the lower tube section 12. If preferred, the arrangement of the tube sections 11 and 12 and their apertures can be reversed, that is, the lower tube section can be the larger diameter tube section and the series of adjusting apertures can be provided in the upper tube section. In any case, the door security brace bar 10 can be adjusted in length through a considerable range, and can be rigidly locked in any selected adjusted position.

The device further comprises a pivoted anti-slip foot piece 16 having a flat plate body 17 and a pair of spaced upstanding apertured lugs 18 rising from the plate body. An apertured head 19 on the lower end of the brace bar 10 receives therethrough a horizontal axis pivot pin 20 which is also received pivotally through the apertures of the upstanding lugs 18. The head 19 is socketed within the lower end of the tube section 12 and is rigidly secured therein by a crosspin 21, FIG. 5. The lower surface of plate body 17 has an anti-friction pad 22, preferably formed of compressible material secured thereto and covering the entire bottom face thereof. The foot piece 16 can pivot freely in either direction on the axis of the pin 20 to assume the required angle during use of the door security brace.

At its top, the brace bar 10 contains a second cross apertured head 23 secured rigidly by a pin 24 within the bore of upper tube section 11, FIG. 3. A double bifurcated yoke 25 in the nature of a flat rigid plate 26 has its lower bifurcated end 27 straddling the head 23 and freely pivotally connected therewith by a pivot pin 28 whose axis is parallel to the pin 20. Both pivot pins are horizontal during use. The other or top bifurcated end 29 of the yoke 25 engages under and around the shank 30 of the interior knob 31 of any horizontally swingable door 32 requiring bracing to bar entry from the exterior of the door. When the yoke 25 is solidly engaged with the knob shank 30 and the foot piece 16 is solidly engaged with the floor, FIGS. 1 and 2, the yoke and foot piece are perpendicular. The yoke 25 is vertical and parallel to the plane of the door and also perpendicular to the axis of the knob shank 30. The plate body 17 of the foot piece is horizontal and therefore parallel to the floor and perpendicular to the door 32. The brace bar 10, after proper length adjustment and locking, is set at an acute angle to the door 32, typically at an angle of 20°–25° to the vertical. Also typically, the lower pivot 20 is about 10″ or 11″ in horizontal spacing from the bottom of the door 32 although these dimensions are not extremely critical and can be varied somewhat.

The anti-friction pad 22 is under substantial compression during use and the bottom of the notch 33 in the double bifurcated yoke 25 exerts firm upward pressure on the horizontal knob shank 30. The yoke 25 is then substantially trapped in a vertical position between the door knob 31 and the adjacent vertical interior surface of the door.

With the above geometry of the adjustable door security brace properly established and with the brace locked rigidly by placement of the pin 15, it is virtually impossible for an intruder to open the door 32 by mere pressure on its exterior. The yoke 25 cannot move on its pivot 28 and the foot piece 16 cannot pivot or slip. The dual parallel axis pivots of the foot piece and yoke are essential for the superior holding action of the device according to the invention compared to the known prior It is to be understood that the form of the invention herewith shown and described is to be taken as a preferred example of the same, and that various changes in the shape, size and arrangement of parts may be resorted to, without departing from the spirit of the invention or scope of the subjected claims.

We claim:

1. A door security brace comprising a length adjustable and lockable brace bar, a floor-engaging foot piece pivotally attached to the lower end of the brace bar on a horizontal pivot axis and having a bottom friction facing, a bifurcated door knob shank-engaging yoke pivotally attached to the top of the brace bar on a horizontal pivot axis which is parallel to the pivot axis of the foot piece, whereby the foot piece and yoke may assume horizontal and vertical perpendicular positions respectively during use with the yoke exerting upward pressure on a door knob shank perpendicular to the axis of the shank while the yoke is parallel to the plane of a door being secured, the foot piece having a substantially flat plate body and said friction facing comprising a compressible anti-slip pad secured to and covering the bottom face of said flat plate body, said yoke comprising a rigid substantially flat plate bifurcated by notching its top and bottom ends, the top end notch of the yoke being adapted to engage under and around a door knob shank and the bottom end notch of the yoke straddling the top of said brace bar, and said brace bar comprising a pair of interengaging longitudinally adjustable sections and means to lock said sections in selected adjusted positions.

2. A door security brace as defined in claim 1, and the brace bar comprising a pair of telescopically engaged tube sections having transverse adjusting apertures adapted to register for establishing various lengths of the brace bar, and a locking pin engageable through selected registering apertures of said tube sections to lock the brace bar rigidly in selected length adjusted positions.

3. A door security brace as defined in claim 2, and apertured heads secured fixedly in the bores of said tube sections at the top and bottom of the brace bar and said apertures being parallel and receiving therethrough a pair of parallel axis pivot pins which also engage within registering apertures of said foot piece and yoke.

* * * * *